United States Patent [19]

Garello

[11] 4,116,374

[45] Sep. 26, 1978

[54] CYLINDER CARRYING STRAP

[75] Inventor: David J. Garello, Napa, Calif.

[73] Assignee: Northwestern Equipment and Supply Co., Berkeley, Calif.

[21] Appl. No.: 820,311

[22] Filed: Jul. 29, 1977

[51] Int. Cl.[2] ..... B65D 71/00

[52] U.S. Cl. ..... 224/55; 294/31.2; 215/100 A

[58] Field of Search ..... 224/49, 45 D, 55, 52, 224/53, 54, 45 C; 294/27 H, 27 R, 31.2, 32; 215/100 A, 100 R; 220/94, 96; 16/110.5

[56] References Cited

U.S. PATENT DOCUMENTS

| | | | |
|---|---|---|---|
| 1,460,268 | 6/1923 | Ottman | 294/31.2 |
| 2,361,417 | 10/1944 | Reichart | 294/31.2 |
| 2,484,531 | 10/1949 | Simmons | 294/31.2 |
| 3,073,493 | 1/1963 | Pfaffenberger | 224/45 P |
| 3,172,586 | 3/1965 | Lu | 224/55 |
| 3,844,459 | 10/1974 | Chambers | 224/55 |

*Primary Examiner*—Trygve M. Blix
*Assistant Examiner*—Kenneth W. Noland
*Attorney, Agent, or Firm*—Bielen and Peterson

[57] ABSTRACT

A hand carrier for cumbersome cylinders such as tanks and the like where it is desired to carry the cylinder in a longitudinally vertical position, the carrier comprising a strap having two generally opposed handles carried on the strap, the handles including pivotal friction plates that orient to the configuration of the cylinder by action of the strap when drawn tightly around the cylinder, the strap having ends that are interconnected by a clamp buckle having means to cinch the strap around the cylinder with sufficient force to frictionally engage the friction plates of the handles with the cylinder.

6 Claims, 4 Drawing Figures

CYLINDER CARRYING STRAP

BACKGROUND OF THE INVENTION

The invention is related to a device for hand carrying bulky or cumbersome items, particularly heavy elongated items that are preferably to be carried in their longtudinally vertical position. The hand carrier device of this invention was devised for carrying conventional gas cylinder tanks such as oxygen tanks, acetylene tanks and other such storage cylinders for liquids or gases. However, the hand carrier device is adaptable for carrying other articles of similar configuration, and for example is useful in moving and setting heavy concrete highway guard rail posts of either circular or square cross section.

The hand carrier device was devised to solve a problem in transporting cylinder tanks where the conventional wheeled hand truck or dolly was unable to operate, either because the terrain was untraversable or because the tank had to be lifted, for example, in loading. Because it is preferred that such tanks be carried in a longitudinally vertical position, and in numbers be storable in a standing flank to flank arrangement, a convenient and utilitarian carrying device had to be capable of firmly attaching to the relatively smooth outer surface of the cylindrical tank, and be easily removeable therefrom, in order to avoid interfering projections such as fixed handles.

Additionally, because the tanks vary in diameter, the carrying device had to be adaptable for equally convenient use for any of a variety of tank sizes and weights.

The hand carrier device of this invention adequately solves these problems, and as noted previously, is adaptable for hand transport of a variety of other articles including articles of different configuration than cylinder tanks.

SUMMARY OF THE INVENTION

The hand carrier device of this invention comprises a strap or belt on which two rigid handles are carried, the strap having a clamp buckle which tightly cinches the strap around the article to be carried. The handles include articulated face plates or friction plates which interface the surface of the article when the strap is cinched. The surface to surface frictional engagement of the face plates and the article, together with additional assistance from the engagement of the strap and the article is sufficient to support by the handles the weight of the article. Necessarily, the article should be strong enough to withstand the constricting forces of the strap around the article's girth without damage to the article.

The handles are constructed to horizontally project from the surface of the article to provide a convenient hand grip. The handles are moveable on the strap prior to tightening of the strap and are generally arranged on opposite sides of the article for convenient grasp by one or two persons. In certain circumstances it may be desirable to utilize only one handle on the strap, for example, in carrying large empty drum containers by gripping the single handle.

The articulated or pivotal nature of the face plates enables the handle structure to adapt itself to cylinders of substantially different diameters as well as articles of other configuration.

While the primary purpose for which the hand carrier was devised was to facilitate carrying of cumbersome gas cylinder tanks, the carrier is adaptable to a variety of other uses of which only a few have been mentioned above.

The nature and preferred construction of the hand carrier device of this invention is described in greater detail in the detailed description of the preferred embodiment hereafter.

DETAILED DESCRIPTION OF THE PREFERRED EMBODIMENT

Figure 1:
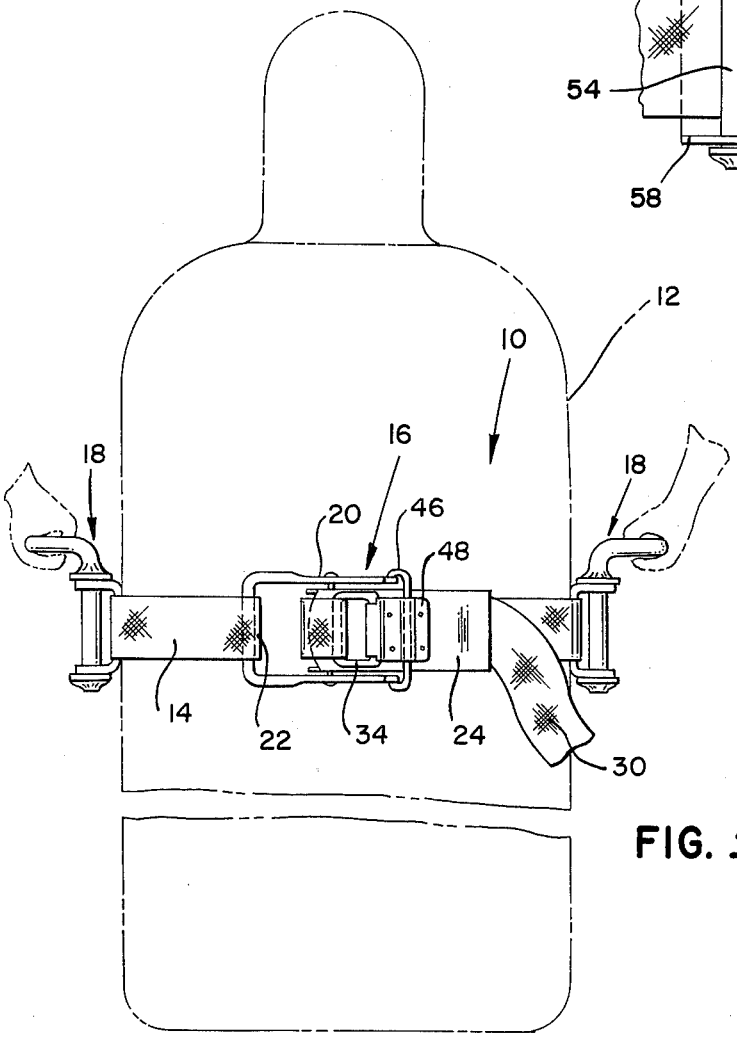
FIG. 1 is a front elevational view of the hand carrier device shown fastened to a gas cylinder tank.

Referring to FIG. 1, the subject hand carrier device, designated generally by the reference numeral 10, is shown fastened around a gas cylinder tank, 12, schematically illustrated in phantom to demonstrate the field use of the carrier device. The carrier device is comprised of three principal components, a strap 14, a clamp buckle 16, and a pair of handle assemblies 18.

The strap 14 is preferably a high strength woven nylon web, which includes the attributes of being light in weight with a limited degree of elasticity yet strong and durable.

The clamp buckle 16 is a known buckling device which cinches the strap 14 when engaged. The buckle 16, also shown in FIG. 2, comprises a toggle 20 connecting to an end loop 22 on the strap 14 formed by an overlay of the strap and which is thoroughly stiched. The toggle 20 is also pivotally connected to a lever plate 24. The lever plate 24 is an elongated flat plate with sides 26 formed by perpendicular folds. The toggle 20 straddles the outside of the plate sides 26 and is connected by a separate pivot pin 28 on each side.

The free end 30 of the strap 14 is carried over a rounded end edge 32 of the plate 24 and around a cinch ring 34 pivotally mounted on the front surface of the lever plate, and back over the edge of the plate, underlapping a portion of the strap. Slack in the strap is eliminated by pulling on the strap end 30.

At the ends of the plate sides 26, the lever plate 24 has a heel 38, which engages the surface of the article to which the carrier device is strapped, to tighten the strap using leverage by force applied to the projecting end 40 of the plate. The strap thereby cinches and tightens around the article.

The toggle 20 latches into the lever plate 24 when the lever plate swings to its clamping position. Notches 42 at the distal ends of extensions 44 on the toggle are engaged by a hooked latching bar 46, swing-mounted to the surface of the lever plate by a retainer bracket 48 which also functions to retain the cinch ring 34.

Figure 2:
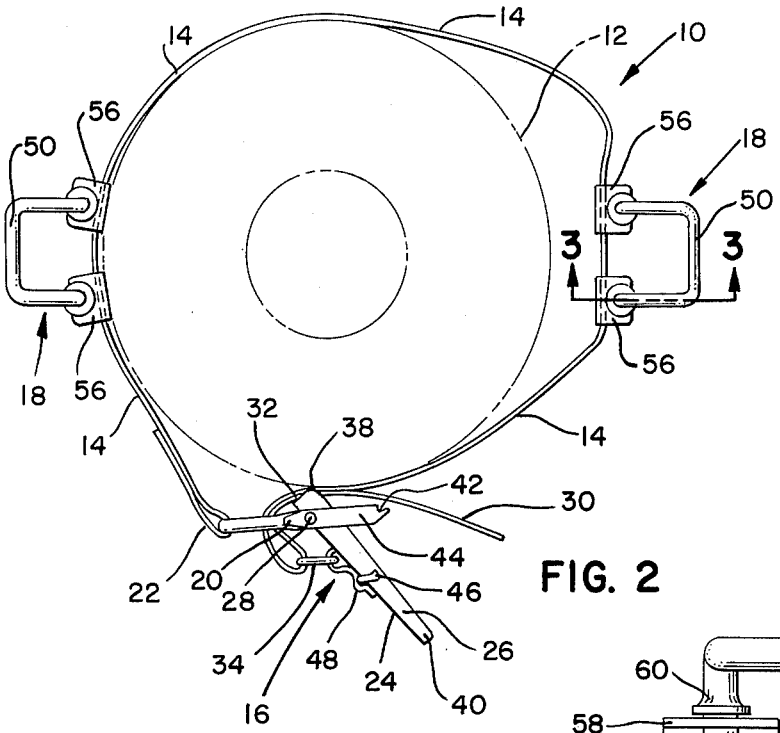
FIG. 2 is a top view of the hand carrier device of FIG. 1 shown loosened around the cylinder tank.
Figure 3:
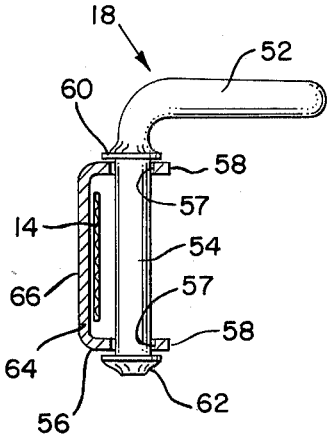
FIG. 3 is a cross sectional side view of a handle assembly taken on the lines 3—3 in FIG. 2.
Figure 4:
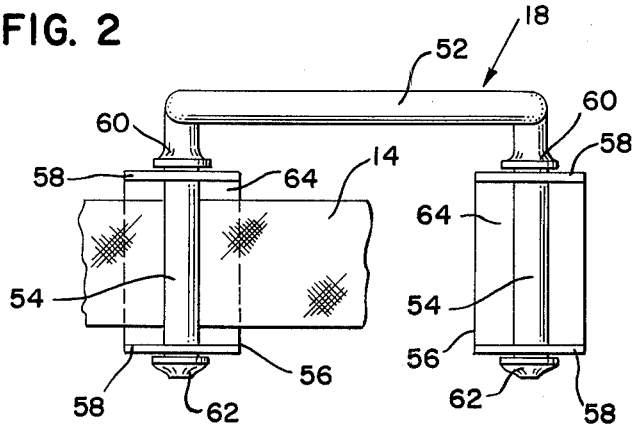
FIG. 4 is a front view of the handle assembly of FIG. 3.

The handle assemblies 18 are shown in FIGS. 1 and 2 strung on the strap in such a manner that they are free to be positioned anywhere along the strap prior to tightening. The construction of the handle assemblies are shown in greater detail by the assembly 18 shown in FIGS. 3 and 4. The handle assembly 18 is constructed with a hand grip member 50 fabricated from a steel rod deformed as shown, with a U-shaped grip portion 52 and spaced leg portion 54 bent perpendicular to the plane of the U-shaped portion.

The handle assembly 18 is connected to a pair of U-brackets 56. In this connection, the leg portions 54 each extend through holes 57 in the parallel, spaced, projecting elements 58 of the U-brackets. The U-brackets are retained on the leg portions by stops, 60 and 62, which are fixed to the leg portions of the hand grip member on each side of the projecting elements 58 with sufficient spacing to allow the brackets to freely swivel. The stops are easily formed by washers welded to the leg portions of the grip member.

A substantially flat back element 64 interconnecting the two projecting elements 58 is spaced from the leg portions 54 of the hand grip 50 to allow the strap 14 to be threaded between the back element 64 and leg portion 54 at each bracket. In this manner, the handle assemblies are freely traversable along the strap allowing the handles to be positioned as desired according to the nature of the article to be carried.

The flat outer surface of the back element 64 comprises a friction face 66 and is the principal contact surface between the carrier device and the article carried. Since the forces applied against the cylinder tank 12, by the belt are constrictive and directly perpendicular to the effective weight force of the tank when the tank is carried in its customary fashion, support of the tank is dependent on the frictional contact between the carrier device and the tank. While special coatings to the friction face 66 may be applied to enhance the frictional characteristics, it has been found that the coarse coating obtained from galvanizing the handle assembly with a protective zinc coating is adequate for gripping the surface of conventional gas cylinder tanks without slippage.

To maximize the frictional engagement between the friction faces and the articles carried, the friction faces must be applied as flat as possible against the surface of the article. Since the surface of the article may vary in size, particularly in diameter, the swivel nature of the U-brackets allows the bracket to position substantially flat against the tank regardless of the diameter of the tank.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. A hand carrier for carrying an elongated article with a peripheral outer surface in a longitudinal orientation that is substantially vertical, comprising:

a. an elongated flat strap having a first end and a second end;

b. a buckle means fastened to said first end for releasably engaging and retaining said second end, said buckle means having means for tightening said strap around the peripheral surface of the article, wherein said strap and buckle means are adapted to encircle the article in a plane generally perpendicular to vertical during carrying;

c. a handle assembly including a substantially horizontally oriented hand grip member having a first end with a rigid friction plate member pivotally connected to said first end, and a second end spaced from said first end with a rigid friction plate member pivotally connected to said second end, said plate members having a friction surface adapted to pivot on a vertical axis and orient substantially flat against the peripheral surface of the article during carrying; and, d. means for connecting said belt member to said handle assembly and forceably directing said friction surface against the peripheral surface of the article.

2. The hand carrier of claim 1 wherein said friction surface of said plate members has a friction coating.

3. The hand carrier of claim 1, wherein said tightening means on said buckle means comprises a toggle connected to said first end of said strap and a lever plate pivotally connected to said toggle, said lever plate having a cinch ring around which said second end of said strap is slip engageable. A projecting end portion for application of a manual force and a displaceable heel portion engageable with an overlapped portion of the second end of said strap, for tightening the strap around an article.

4. The hand carrier of claim 1 wherein said hand grip member has a substantially U-shaped configuration with a grip portion with ends and two extension portions with distal ends integrally extending normal to the grip portion, said first and second ends located at the distal ends of said extension portions.

5. The hand carrier of claim 4 wherein said pivotal connection of said friction plate members to said first and second ends of said hand grip member comprises an integral rigidly connected leg element depending from each of said first and second ends of said hand grip member perpendicular to the plane of said grip portion and extension portions of said U-shaped hand grip member, said plate members each comprising a U-bracket having parallel spaced projecting portions and a face portion interconnecting said projecting portions, said projecting portions having aligned holes, wherein said depending leg element extends through said holes, said plate member being pivotally arranged on said leg element, said leg element having retainer means for retaining said U-bracket on said leg element.

6. The hand carrier of claim 5, wherein said leg elements are displaced from said face portion of said plate members, and wherein said strap is threaded between said leg elements and face portions of said plate members.

* * * * *